United States Patent [19]

Castonguay et al.

[11] Patent Number: 5,059,933

[45] Date of Patent: Oct. 22, 1991

[54] MOLDED CASE CIRCUIT BREAKER OPERATING CRADLE CONFIGURATION

[75] Inventors: Roger N. Castonguay, Terryville; David Arnold, Chester, both of Conn.

[73] Assignee: General Electric Company, New York, N.Y.

[21] Appl. No.: 582,683

[22] Filed: Sep. 14, 1990

[51] Int. Cl.[5] ..... H01H 9/20

[52] U.S. Cl. ..... 335/167; 335/22

[58] Field of Search ..... 335/21-23, 335/35, 167-174

[56] References Cited

U.S. PATENT DOCUMENTS 4,302,740 11/1981 Maier et al. ..... 335/21
4,622,530 11/1986 Ciarcia et al. ..... 335/167
4,679,019 7/1987 Todaro et al. ..... 335/172
4,736,174 4/1988 Castonguay et al. ..... 335/167
4,806,893 2/1989 Castonguay et al. ..... 335/20
4,864,263 9/1989 Castonguay et al. ..... 335/167

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

A molded case circuit breaker of the type containing an electronic trip unit and a combined acutator-accessory unit to articulate the circuit breaker operating mechanism employs an optimum cradle configuration within the circuit breaker operating mechanism. The optimized cradle interacts with the circuit breaker latch assembly to substantially reduce the tripping force required to articulate the operating mechanism.

4 Claims, 4 Drawing Sheets

MOLDED CASE CIRCUIT BREAKER OPERATING CRADLE CONFIGURATION

BACKGROUND OF THE INVENTION

U.S. Pat. No. 4,806,893 entitled "Molded Case Circuit Breaker Actuator-Accessory Unit" describes the use of an electromagnetic actuator within an actuator-accessory unit to articulate a circuit breaker operating mechanism to separate the circuit breaker contacts upon the occurrence of an overcurrent condition of predetermined magnitude. An electronic trip unit in combination with current transformers are used within so-called "electronic trip" circuit breakers to sense the circuit current and determine when such a tripping function should be inputted to the actuator-accessory unit. The electronic trip unit and actuator-accessory unit replace prior art thermally and magnetically active trip elements which respond to changing circuit current in an analog fashion.

The operating mechanism and latch assembly used within the electronic trip circuit breakers are described in U.S. Pat. No. 4,736,174 entitled "Molded Case Circuit Breaker Operating Mechanism" and U.S. Pat. No. 4,864,263 entitled "Molded Case Circuit Breaker Latch and Operating Mechanism Assembly".

The "tripping force" for purposes of this disclosure is defined as the amount of force required to displace the operating mechanism latch from the operating cradle to allow the operating springs to overcenter and separate the circuit breaker contacts.

With higher ampere-rated circuit breakers, a higher tripping force is generally required to overcome the higher latching forces generated between the operating cradle and the latch assembly. U.S. patent application Ser. No. 518,673 filed May 3, 1990 and entitled "Tripping Arrangement for Molded Case Circuit Interrupter" describes a supplemental tripping assembly for providing additional trip force to one such higher ampere-rated industrial circuit breaker. Another approach to compensate for the higher trip forces required with higher ampere-rated industrial circuit breakers is to provide a supplemental latch in combination with the latch assembly which effectively reduces the latching forces. One such supplemental latch is found within U.S. patent application Ser. No. 526,481 filed May 21, 1990 and entitled "Molded Case Circuit Breaker Compact Latch Assembly". All of the aforementioned U.S. Patents and Patent Applications are incorporated herein for reference purposes.

It would be economically advantageous to reduce the tripping force in molded case circuit breakers without requiring a supplemental tripping mechanism or supplemental latch assembly. Accordingly, one purpose of the instant invention is to provide an operating cradle configuration that requires a reduced tripping force to displace the operating cradle from the circuit breaker latch assembly.

SUMMARY OF THE INVENTION

The operating cradle within a circuit breaker operating mechanism is provided with a radial surface on the so-called "cradle hook" that interfaces with the operating mechanism latching surface. The cradle hook radial surface immediately releases from the latching surface when the latch is displaced by operation of the actuator-accessory unit.

DESCRIPTION OF THE PREFERRED EMBODIMENT

Figure 1:
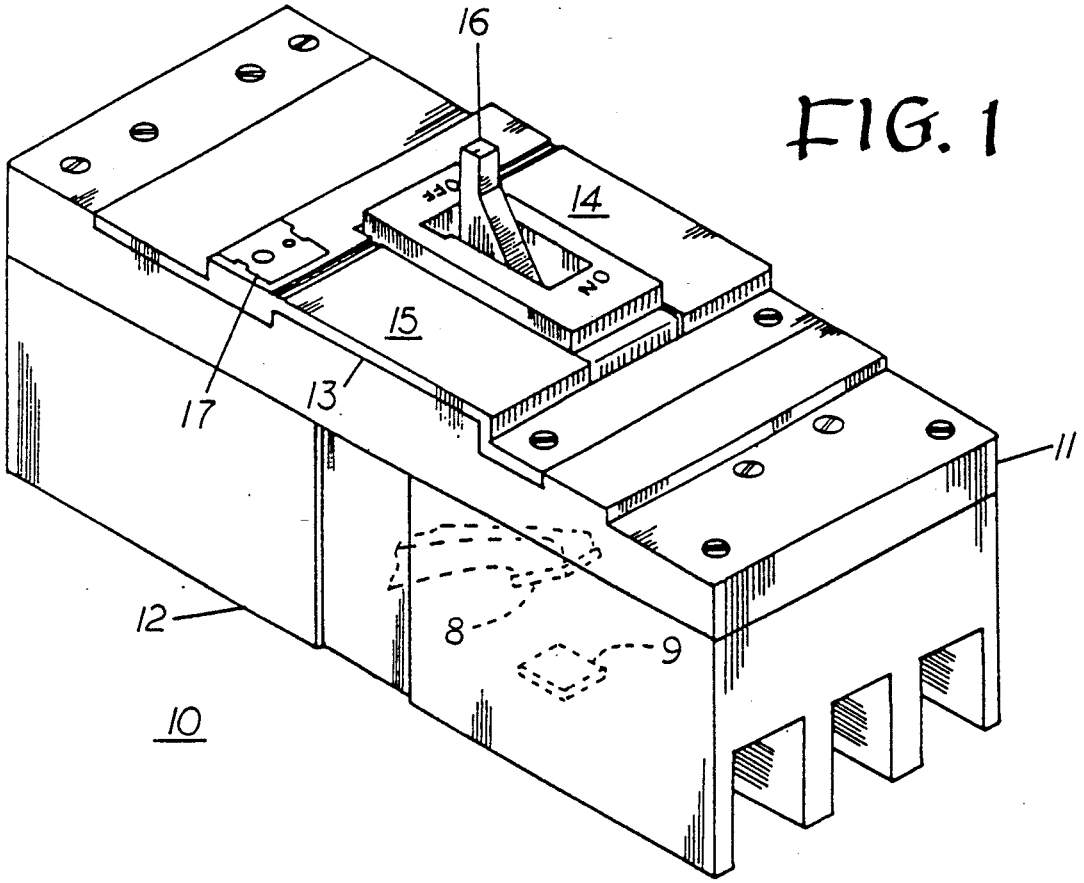
FIG. 1 is a top perspective view of a circuit breaker employing the operating cradle in accordance with the invention.

An electronic trip circuit breaker 10 hereafter "circuit breaker" is depicted in FIG. 1 and consists of a molded plastic case 12 to which a molded plastic cover 11 is fixedly secured. An accessory cover 13 is attached to the circuit breaker cover and includes a pair of accessory doors 14, 15 for accessing the actuator-accessory unit contained within the circuit breaker cover and for accessing an auxiliary accessory such as an undervoltage release unit or auxiliary switch contained in a separate compartment within the circuit breaker cover. An operating handle 16 extends through the circuit breaker cover for turning the circuit breaker contacts 8, 9 between their closed and open positions. A rating plug 17 interconnects with the electronic trip unit to set the ampere rating of the circuit breaker.

Figure 2:
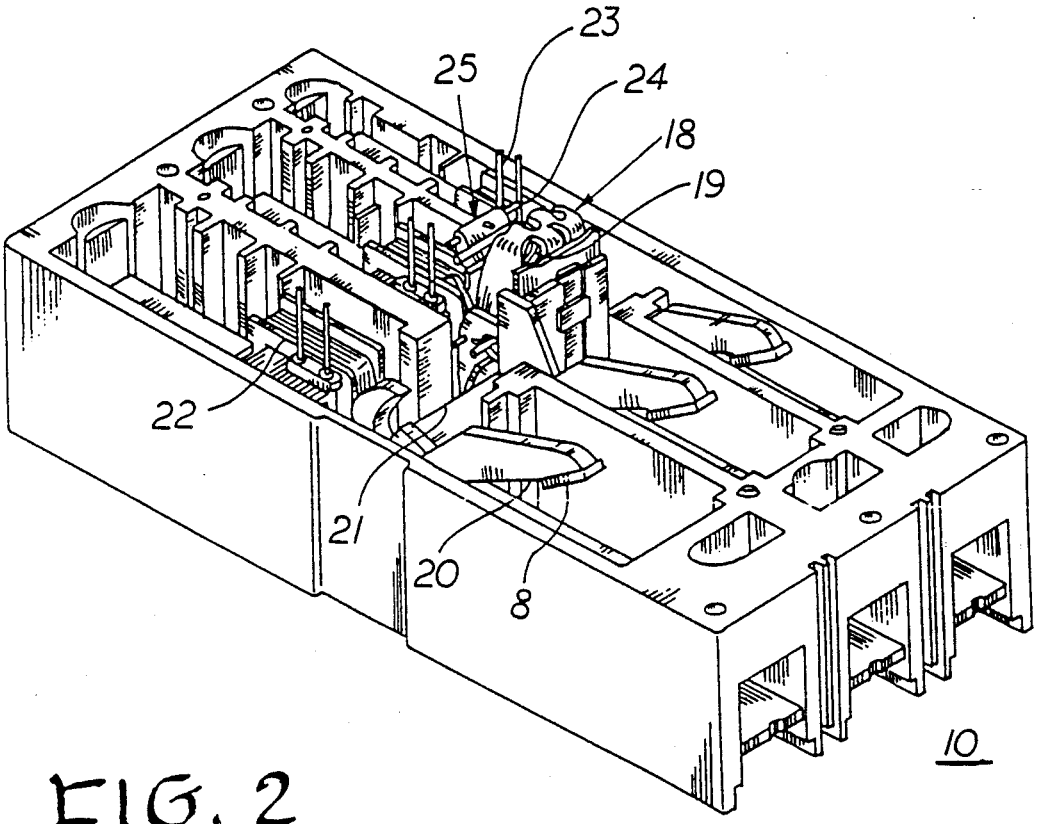
FIG. 2 is a top perspective view of the circuit breaker of FIG. 1 with the cover removed to depict the operating mechanism.

The circuit breaker 10 is depicted in FIG. 2 with the circuit breaker cover removed to show the circuit breaker operating mechanism 18 which includes a pair of powerful operating springs 19 to drive the movable contact arm 20 and the attached movable contact 8 to the open position indicated in FIG. 2. Contacting the trip bar 24 attached to the latch assembly 25 allows the crossbar 21 and the associated movable contact arms 20 to be driven to the open position by articulating the circuit breaker operating mechanism. Three current transformers 22, one in each separate compartment, sense the circuit current and are electrically connected with the electronic trip unit contained within the circuit breaker cover by means of pin connectors 23.

Figure 3:
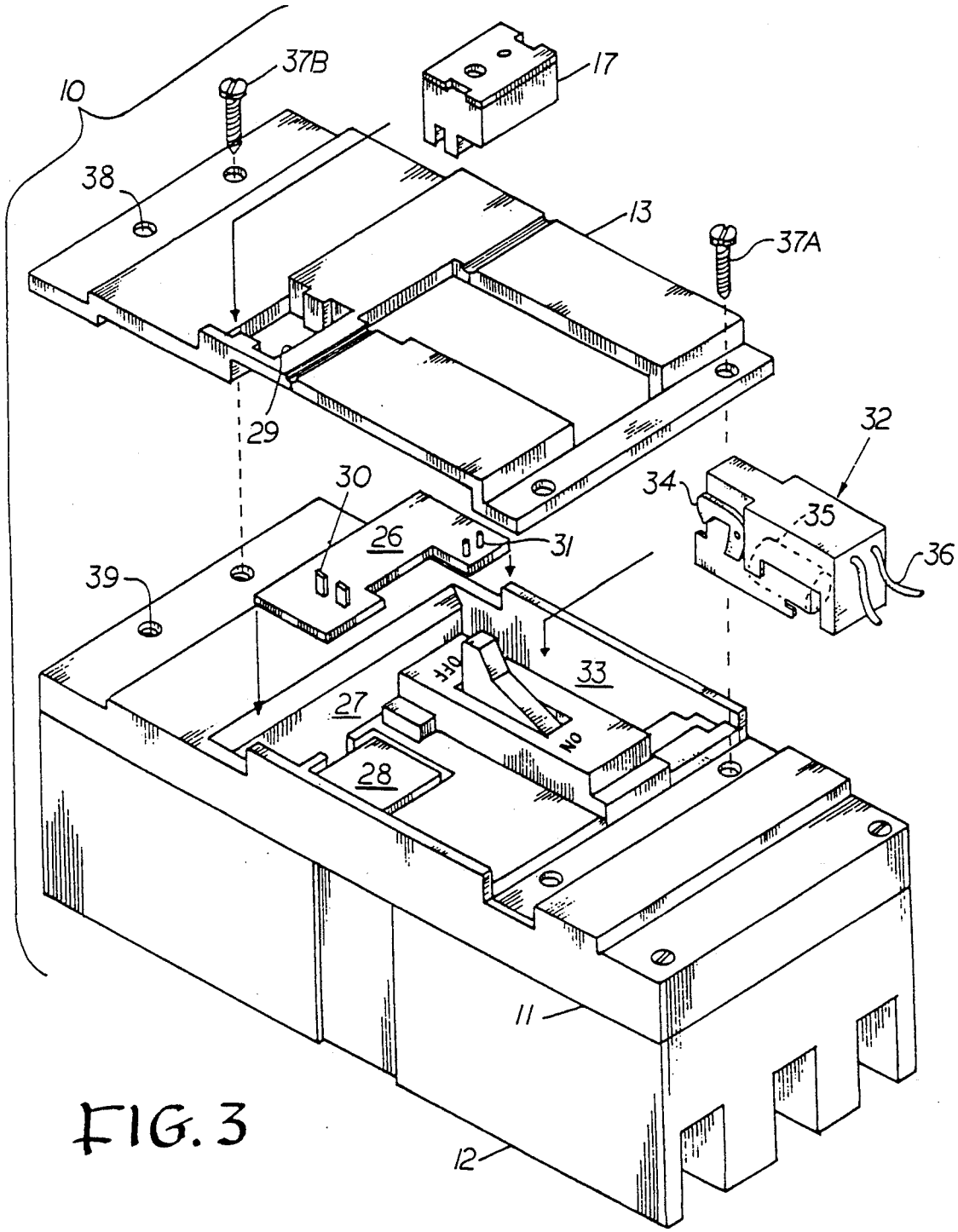
FIG. 3 is a top perspective view of the circuit breaker of FIG. 1 with the trip actuator assembly depicted in isometric projection.

The interaction between the actuator-accessory unit and the trip bar to unlatch the operating mechanism is best seen by referring now to FIG. 3, wherein the circuit breaker 10 is depicted with the cover 11 attached to the case 12 but prior to the attachment of the accessory cover 13 to the circuit breaker cover 11. The printed circuit board 26 containing the electronic trip unit is inserted within the corresponding trip unit recess 27 and the actuator-accessory unit 32 is inserted within the actuator-accessory recess 33. Electrical connection between the trip unit and the actuator-accessory unit is made by means of the pin connectors 31 upstanding from the trip unit. External electrical connection with the actuator-accessory unit for remote control function is achieved by means of a pair of conductors 36. The trip solenoid 35 controls the position of the actuator latch 34 which restrains the circuit breaker operating mechanism in a manner to be discussed below in greater detail. An accessory unit 28 is inserted within the circuit breaker cover before attachment of the accessory cover 13 by means of screws 37A, 37B, thru-holes 38 and threaded openings 39. The rating plug 17 is inserted within the rating plug recess 29 and electrically connects with the trip unit 26 by means of the pin connectors 30 upstanding from the trip unit.

Figure 4:
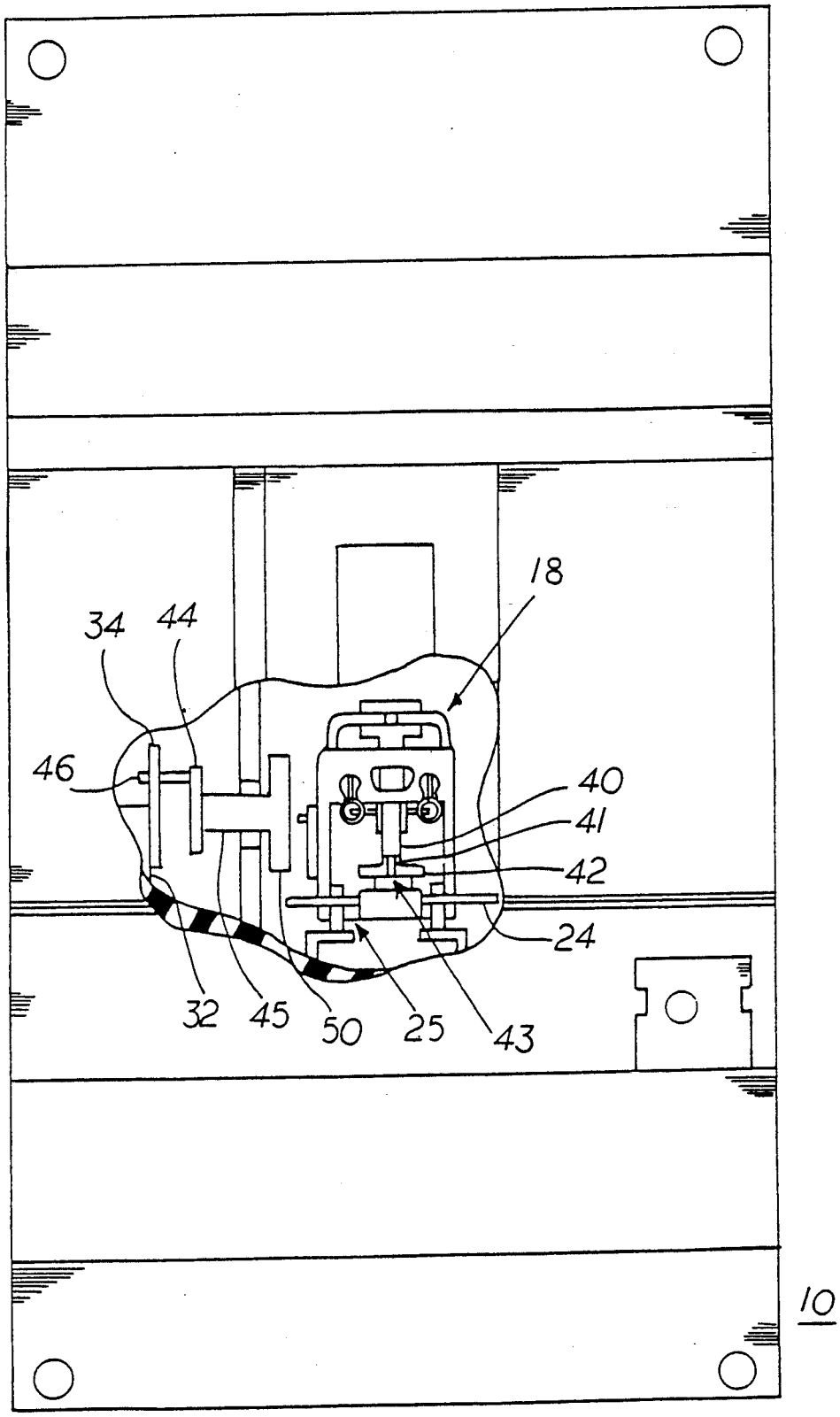
FIG. 4 is a top plan view of the circuit breaker of FIG. 1 with the circuit breaker cover partially removed to depict the interaction between the actuator-accessory unit and the operating mechanism.

The interaction between the trip unit and the actuator-accessory unit is best seen by referring now to FIG. 4. As described within the aforementioned U.S. Pat. No. 4,806,893, the actuator-accessory unit 32 within the cover of the circuit breaker 10 interacts with the operating mechanism 18 by means of a spring-loaded mechanical actuator 44. The latch pin 46 on the mechanical actuator is restrained by the actuator latch 34 on the actuator-accessory unit from rotating the actuator arm 50 into contact with the trip bar 24 extending from the latch assembly 25. The latch assembly includes a secondary latch 43 that abuts the primary latch 42 and restrains the cradle hook 41 at the end of the operating cradle 40. The actuator-accessory unit responds to an overcurrent condition releasing the actuator latch 34 and allows the mechanical actuator connecting arm 45 to rotate and drive the mechanical actuator arm 50 into contact with the trip bar 24. This displaces the secondary latch 43 and allows the primary latch 42 to release the cradle hook 41 and rotate the operating cradle 40 free from the latch assembly 25.

Figure 5A:
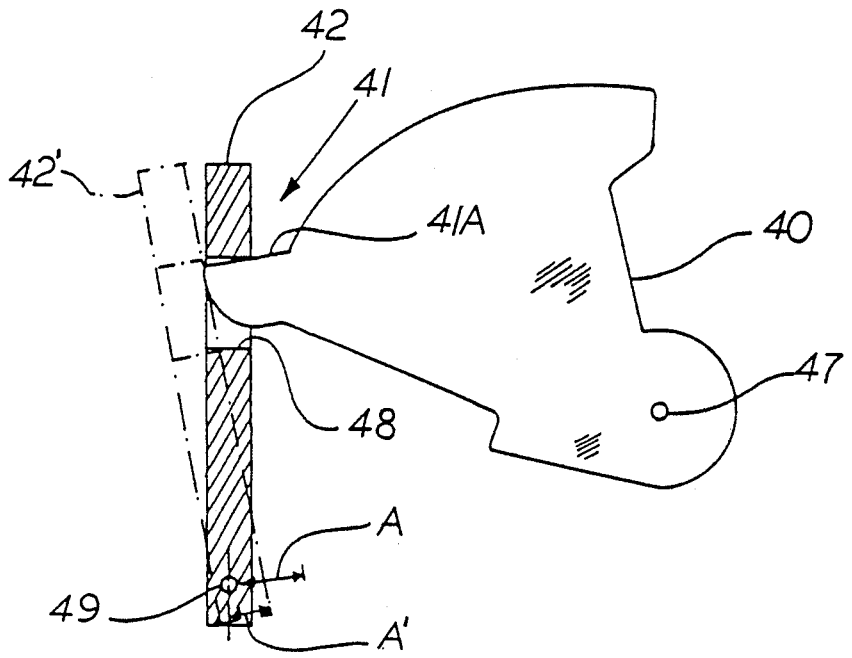
(PRIOR ART) FIG. 5A
FIGS. 5A, 5B are enlarged side views of the operating cradle according to the Prior Art and in accordance with the invention respectively.

The cradle hook 41 is depicted at the end of the operating cradle 40 in FIG. 5A as having a planar surface 41A in accordance with the prior art configuration. The operating cradle is pivotally arranged about the cradle pivot 47 such that the cradle hook 41 extends within the rectangular aperture 48 within the primary latch 42 such that a latching force is developed at the point of contact between the primary latch and the cradle hook by the operating mechanism operating springs 19 shown earlier with reference to FIG. 2. When the secondary latch 43 of FIG. 4 is moved away from the primary latch 42 the primary latch rotates counterclockwise about the primary latch pivot 49 to the position indicated in phantom at 42'. The moment of the latching force between the operating cradle 40 and the primary latch 42 is defined as the product of the latching force times the distance that a line of force perpendicular to the planar surface 41A extends parallel to a line extending from the primary latch pivot 49. It is noted in the prior art embodiment depicted in FIG. 5A, that an initial moment applied to the cradle hook 41, as indicated at A, is larger than the final moment wherein the cradle hook is at the edge of the primary latch as indicated at A' which constitutes the "unlatched" condition of the cradle operator. The perpendicular line has therefore moved closer to the primary latch pivot as the primary latch moves from the initial position indicated at 42 to the final position indicated at 42'. Hence, in order to initially overcome the larger latching moment applied to the cradle hook, a correspondingly large tripping force must be applied to completely displace the secondary latch.

Figure 5B:
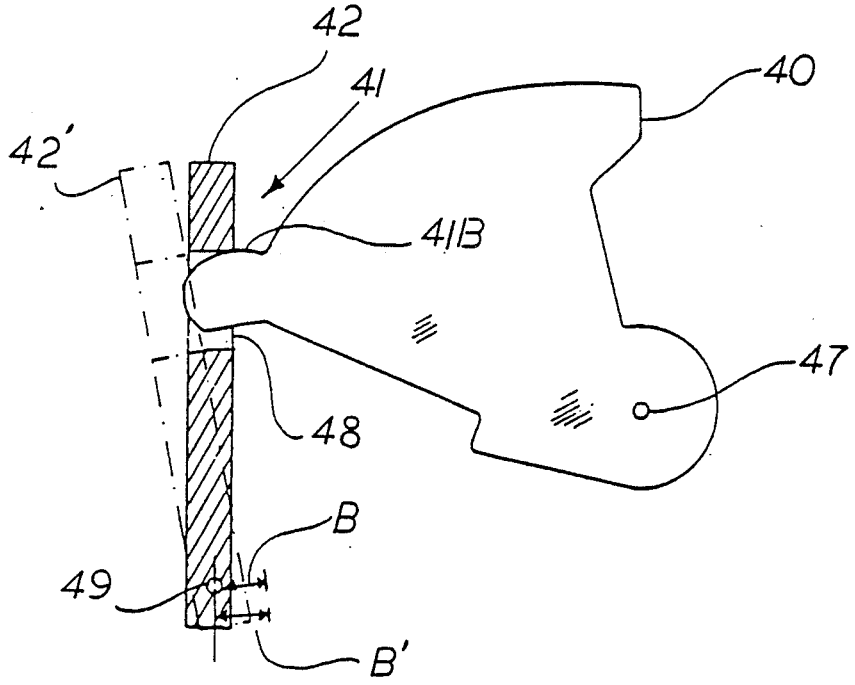

In accordance with the invention, the operating cradle 40, depicted in FIG. 5B, is arranged to rotate about a similar cradle pivot 47 when the cradle hook 41 is displaced from a similar rectangular aperture 48 in the primary latch 42. The cradle hook 41 is provided with a radial surface 41B such that a line perpendicular to a tangent to the radial surface will remain a fixed distance from a parallel line extending through the primary latch pivot 49 as indicated at B with the cradle operator "latched" initially and at B' after the primary latch has rotated counterclockwise to the position indicated at 42' with the cradle hook at the very edge of the primary latch and the cradle operator unlatched. This results in a constant moment of force between the cradle hook and the primary latch as the primary latch moves from the latched to the unlatched positions.

The use of a radial surface on the cradle hook to interface with the primary latch to provide a lighter latching force has heretofore not proved feasible with so-called "analog" displacement of the secondary latch from the primary latch. A slight displacement of the secondary latch as commonly occurs with thermal and magnetic trip elements such as the earlier-described bi-metals and electromagnets with transient overcurrent surges could possibly overcome the lighter latch forces exerted between the radial surface on the cradle hook and the primary latch surface and result in so-called "nuisance tripping". The "digital" operation of the actuator-accessory unit described earlier, which only operates to contact the trip bar when the actuator-accessory unit is energized, works very well with the reduced latching force since a tripping force is only provided by the actuator-accessory unit when such tripping is desired. To compensate for manufacturing tolerances which could otherwise cause variations between the distance factor described earlier, the radius of curvature defining the radial surface on the cradle hook approximates the distance defined between the latching surface on the primary latch and the primary latch pivot 49.

Having thus described our invention, what we claim as new and desire to secure by Letters Patent is:

1. A molded case circuit breaker comprising:

a plastic cover joined to a plastic case;

a pair of separable contacts within said case controlled by an operating mechanism;

a pair of springs within said operating mechanism arranged for driving said contacts to their open position;

a latch system coupled with said operating mechanism restraining said operating mechanism from separating said contacts until occurrence of an overcurrent condition of predetermined magnitude, said latch system includes a primary latch having a cradle slot receiving said latching end of said cradle operator and a second latch interacting with said primary latch to thereby prevent rotation of said cradle operator, said primary latch rotated about a first pivot located a first distance from said cradle slot to move from a latched position to an unlatched position to thereby release said cradle operator from said primary latch.

said cradle operator radial surface defines a radius of curvature resulting in a constant moment of force exerted between said primary latch and said cradle operator as said primary latch moves from said latched to said unlatched position; and a cradle pivotally-arranged within said case and connecting between said latch system and said operating mechanism, said cradle operator having a pivot end and an opposing latching end said latching end interacting with said latch system whereby said cradle operator releases from said latch system to allow said operating mechanism to separate said contacts upon occurrence of said overcurrent condition, said latching end having a radial surface engaging an edge of said cradle slot.

2. The circuit breaker of claim 1 including an actuator within said cover arranged for contacting said secondary latch and driving said secondary latch away from said primary latch to allow said primary latch to release said cradle operator.

3. The circuit breaker of claim 2 wherein said actuator includes an electromagnet.

4. The circuit breaker of claim 1 wherein said radius of curvature approximates said first distance.

* * * * *